US005272296A

United States Patent [19]

Robarge et al.

[11] Patent Number: 5,272,296

[45] Date of Patent: Dec. 21, 1993

[54] MOLDED CASE CIRCUIT BREAKER VARIABLE ACTUATOR MECHANISM

[75] Inventors: Dean A. Robarge, New Britain; Robert G. Markowski, East Haven, both of Conn.

[73] Assignee: General Electric Company, New York, N.Y.

[21] Appl. No.: 561,760

[22] Filed: Aug. 2, 1990

[51] Int. Cl.[5] ..... H01H 3/20

[52] U.S. Cl. ..... 200/331; 200/337

[58] Field of Search ..... 200/50, 50 A, 50 C, 200/329-331, 332.1, 335-338; 361/335, 337-339, 343, 353, 356-357

[56] References Cited

U.S. PATENT DOCUMENTS

| | | | |
|---|---|---|---|
| 2,692,932 | 10/1954 | Parke et al. | 200/331 |
| 3,087,039 | 4/1963 | Bachman | 439/212 |
| 3,142,003 | 7/1964 | Olashaw | 439/212 |
| 3,343,042 | 9/1967 | Cellerini | 361/339 |
| 3,939,725 | 2/1976 | Fisher | 200/331 |
| 4,305,114 | 12/1981 | Takagi | 361/339 |
| 4,419,549 | 12/1983 | Osborne | 200/50 A |
| 4,553,799 | 11/1985 | Peters | 439/839 |
| 4,626,638 | 12/1986 | Samples et al. | 200/331 |
| 4,744,003 | 5/1988 | Koslosky et al. | 361/363 |
| 4,782,427 | 11/1988 | Marks | 361/356 |
| 4,945,450 | 7/1990 | Sabatella et al. | 361/391 |
| 5,193,666 | 3/1993 | Markowski et al. | 200/331 |

FOREIGN PATENT DOCUMENTS

| | | | |
|---|---|---|---|
| 3544227 | 6/1987 | United Kingdom | 361/339 |

*Primary Examiner*—Gregory D. Thompson

[57] ABSTRACT

A remote actuator for an enclosed molded case circuit breaker utilizes an actuator cable connection with the circuit breaker operating handle in a "pull-pull" arrangement. The cable is arranged in an endless loop between the actuator handle and the circuit breaker operating handle. Moving the actuator handle in a first direction pulls the circuit breaker operating handle to its ON position while moving the actuator handle in an opposite direction pulls the circuit breaker operating handle to its OFF position.

10 Claims, 4 Drawing Sheets

MOLDED CASE CIRCUIT BREAKER VARIABLE ACTUATOR MECHANISM

BACKGROUND OF THE INVENTION

U.S. Pat. No. 4,945,450 entitled "Modular Electric Switch-Circuit Breaker Assembly" describes a switchboard used within an industrial electrical power distribution system. A plurality of switches and circuit breakers are mounted within the interior of the switchboard. When a molded case circuit breaker is mounted within the switchboard interior, an externally-accessible actuator handle is required to move the circuit breaker operating handle between its ON and OFF positions. One operating system for remote electrical equipment which uses a flexible push-pull type cable to connect between the actuator handle and the circuit breaker handle is described within U.S. Pat. No. 4,626,638.

The aforementioned U.S. Pat. No. 4,626,638, requires a mechanical linkage interposed between the operating handle and the cable to affect the push-pull relationship between the actuator handle and the circuit breaker operating handle.

It would be economically advantageous to affect a direct connection between the actuator handle and the cable and a corresponding direct connection between the cable and the circuit breaker operating handle without requiring any intervening mechanical linkage assembly.

One purpose of this invention is to provide an actuator mechanism which includes a direct connection between the actuator handle and the cable as well as between the circuit breaker and the cable in an endless loop configuration without requiring any intervening mechanical linkage assembly.

SUMMARY OF THE INVENTION

A circuit breaker actuator mechanism allows a molded case circuit breaker contained within an enclosure to be turned ON and OFF from outside the enclosure by means of a cable connection between the circuit breaker operating handle and the externally accessible actuator handle in an endless loop. The endless loop allows the actuator handle to associate with the circuit breaker handle in a pull-pull arrangement whereby the circuit breaker operating handle is pulled both to its ON and its OFF positions.

DESCRIPTION OF THE PREFERRED EMBODIMENT

Figure 1:
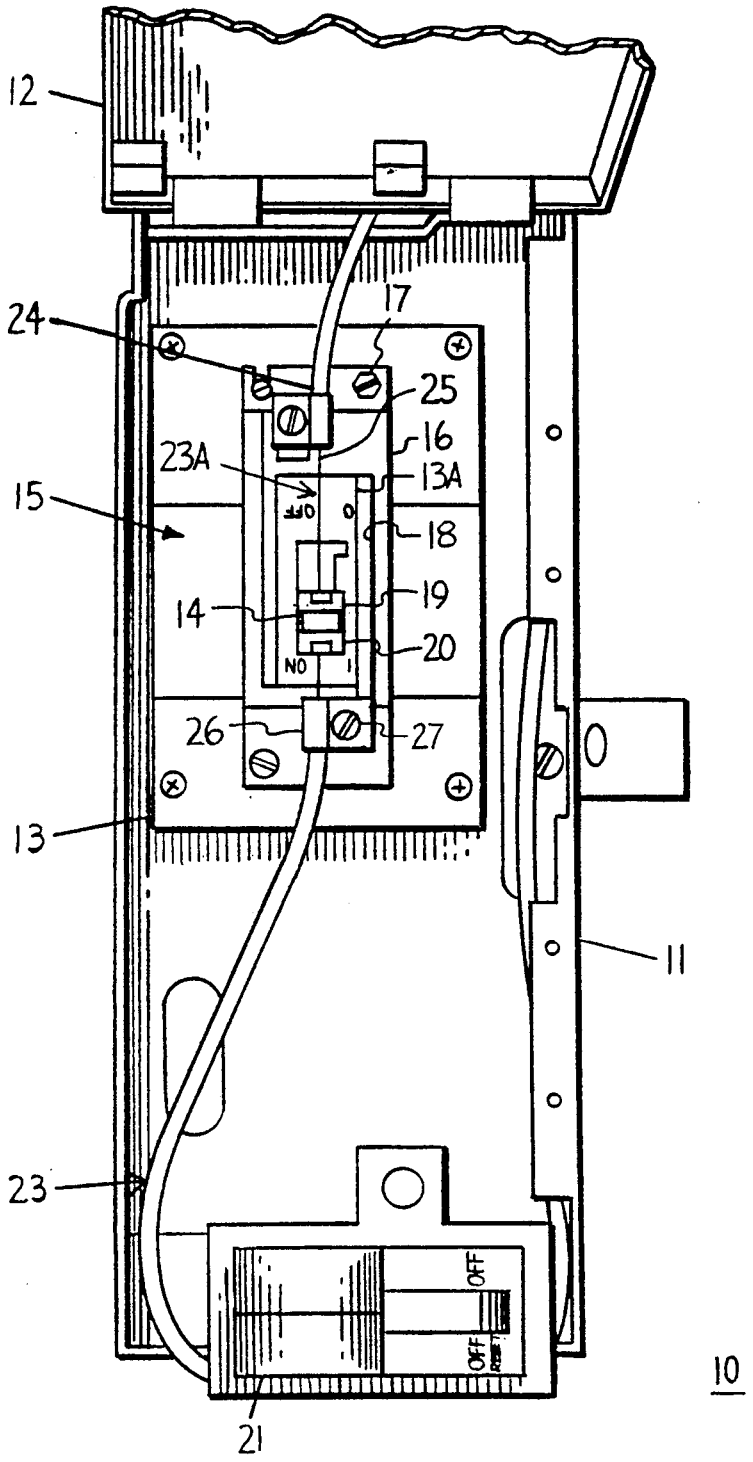
FIG. 1 is a front perspective view of a circuit breaker enclosure including the variable actuator mechanism in accordance with the invention.

An enclosed disconnect switch or enclosed circuit breaker 10 is shown in FIG. 1 wherein the circuit breaker 13 is mounted within a modular enclosure 11 having a hingeable cover 12. In order to operate the circuit breaker exterior from the enclosure, an actuator mechanism 15 is operatably connected with the circuit breaker operating handle 14 by means of an endless cable 23 that runs between the circuit breaker operating handle and the actuator mechanism handle 21. The actuator mechanism includes a stepped support platform 16 that attaches directly to the circuit breaker by means of screws 17, as indicated. The circuit breaker escutcheon 13A extends upwards through a rectangular aperture 18 formed in the support platform and the cable 23 is attached to the platform at opposite ends of the aperture. The cable comprises an outer insulative sheath 24 and an inner flexible wire 25 where the wire is exposed at the strapped cable portion indicated at 23A and is connected to the circuit breaker operating handle by a pair of U-shaped plates 19, 20 in a manner that will be described below in greater detail. The cable sheath is attached to the platform at one side of the rectangular aperture by means of a cable clamp 26 and a screw 27 and by means of a similar cable clamp and screw at the opposite side of the aperture. The attachment of the cable sheath to the platform allows the flexible wire 25 to reciprocate between the circuit breaker operating handle and the actuator mechanism handle in an endless loop.

Figure 2:
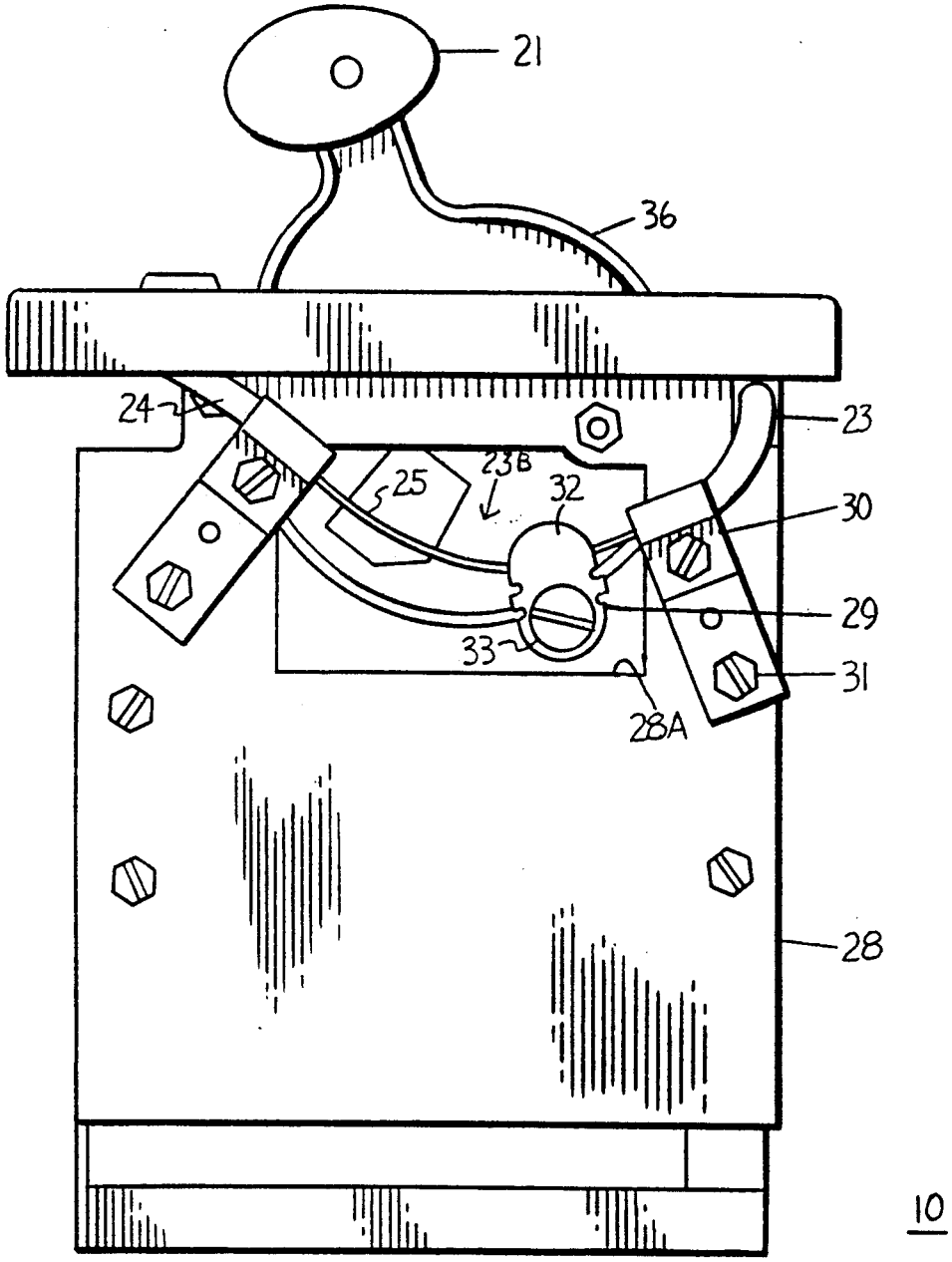
FIG. 2 is an enlarged end view of the enclosure of FIG. 1.

The connection between the actuator mechanism handle 21 and the flexible wire 25 is best seen by referring to the enclosed circuit breaker 10 depicted in FIG. 2. A similar stripped cable portion 23B extends between a pair of similar cable clamps 30 that attach the cable sheath 24 of the cable 23 to the end 28 of the circuit breaker enclosure by means of screws 31. The actuator mechanism handle 21 is integrally-formed with a circular lever 36 from which a post 29 extends within the rectangular aperture 28A formed through the end 28 of the enclosure. The flexible wire 25 extends between the cable clamps arranged at the opposite ends of the aperture and is fastened to the actuator mechanism handle by means of a wire grip 32 that is fastened to the post 29 by means of a screw 33. Rotating the actuator mechanism handle 21 in the counterclockwise and clockwise direction as viewed in FIG. 2 correspondingly pulls the flexible wire 25 in the counterclockwise and clockwise directions.

Figure 3:
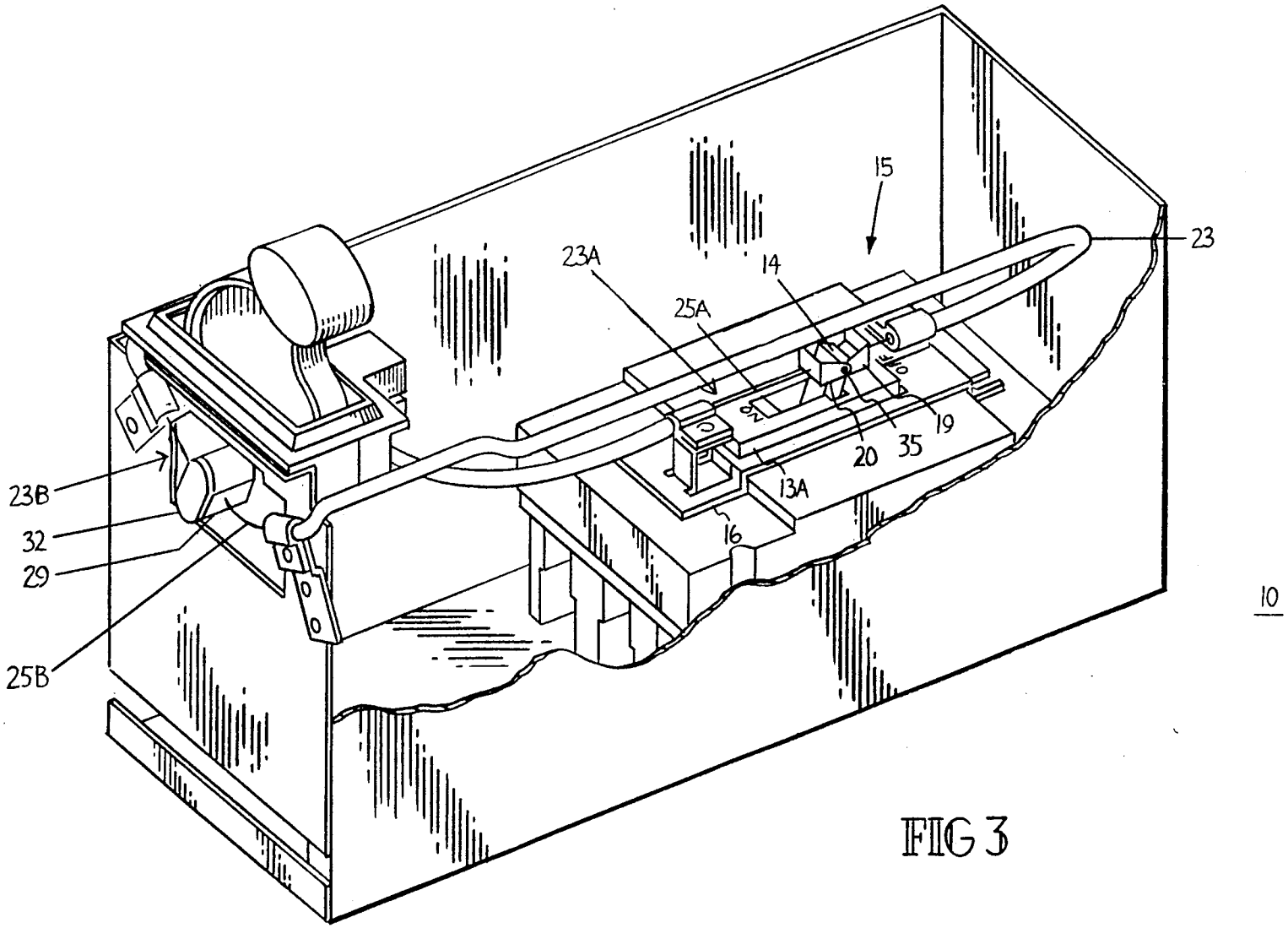
FIG. 3 is a top perspective view of the enclosure of FIG. 1 with the circuit breaker operating handle depicted in its OFF position.
Figure 4:
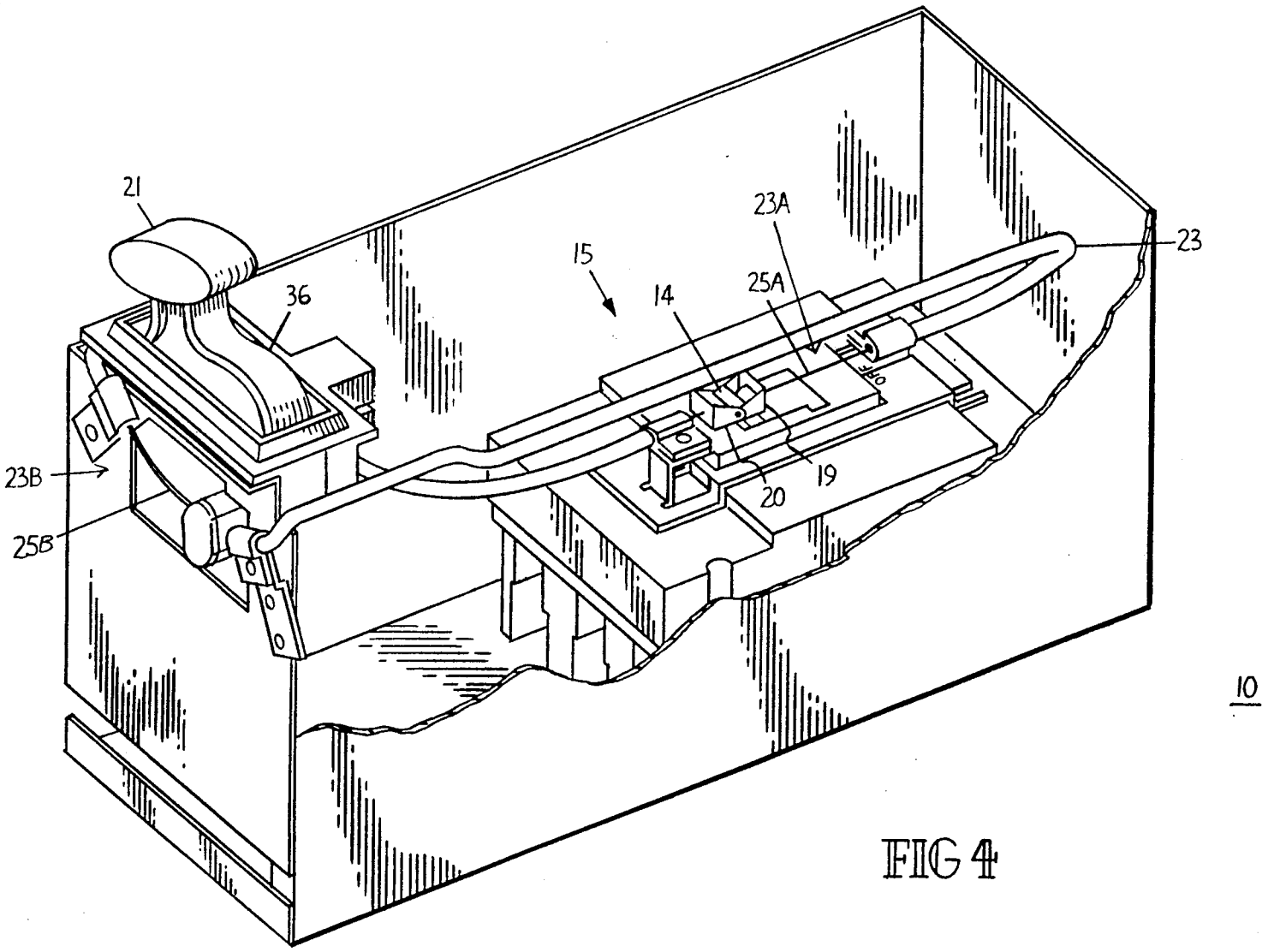
FIG. 4 is a top perspective view of the circuit breaker enclosure with the circuit breaker operating handle in the "ON" position.

The corresponding movement of the circuit breaker operating handle 14 in the clockwise and counterclockwise directions is best seen by referring now to FIGS. 3 and 4. The enclosed circuit breaker 10 is depicted in FIG. 3 with the circuit breaker operating handle 14 in the OFF position where the U-shaped plates 19, 20 are pivotally attached to the circuit breaker operating handle by means of a pivot pin 35. The U-shaped plates respond to the reciprocal motion of the flexible wire to pull the circuit breaker operating handle between the ON and OFF switch positions indicated on the circuit breaker escutcheon 13A. The exposed flexible wire part 25A in the stripped cable portion 23A of the endless cable 23 within the actuator mechanism 15 is shown as a continuous loop with the exposed wire part 25B in the stripped cable portion 23B where the exposed flexible wire part 25B is attached to the wire grip 32 and the post 29 as described earlier. In FIG. 4, the enclosed circuit breaker 10 is depicted with the actuator mechanism handle 21 and handle lever 36 within actuator mechanism 15 rotated to the ON position such that the exposed flexible wire part 25B shown within the exposed cable portion 23B of cable 23 has pulled the circuit breaker operating handle 14 to its corresponding ON position as indicated by the position of the exposed flexible wire part 25A and U-shaped plates 19, 20 depicted within the stripped cable portion 23A.

It is thus seen that the movement of the actuator mechanism handle within the actuator mechanism causes immediate transfer of the circuit breaker operating handle to either its ON or OFF position by the arrangement of the cable in an endless loop and by the provision of the exposed cable portions as indicated.

Although an enclosed circuit breaker is described herein, it should be clearly understood that other types of enclosed circuit interruption devices, such as disconnect switches can also be used with the actuator mechanism of the invention.

Having thus described our invention, what we claim as new and desire to secure by Letters Patent is:

1. A variable actuator mechanism comprising:

an actuator lever adapted for rotatable attachment to one end of an enclosure containing an electrical interruption device;

an actuator handle attached to said lever;

a support platform adapted for fixed attachment to an interruption device contained within an enclosure; and a cable comprising a flexible wire within an insulative sheath connecting between said actuator lever and said support platform, said sheath being partially removed to expose a first part of said wire, said first part being attached to said actuator lever and said sheath being further partially removed to expose a second part of said wire, said second part being attached to a pair of plates adapted to be arranged on either side of an operating handle on an electrical interruption device.

2. The mechanism of claim 1 wherein said cable is arranged as an endless loop within an enclosure.

3. The mechanism of claim 1 including an aperture formed within said support platform, said aperture adapted to receive an operating handle of an electrical interruption device.

4. The mechanism of claim 1 wherein said actuator lever includes an attachment post adapted to extend through an aperture in an enclosure.

5. The mechanism of claim 1 wherein said first part of said wire is adapted to be pivotally-attached to an electrical interruption device operating handle by means of said pair of plates.

6. The mechanism of claim 4 wherein said second part of said wire is attached to said post by means of a wire grip.

7. The mechanism of claim 1 wherein said support platform is arranged in a stepped configuration, a lower part of said platform being adapted to be attached to a cover on an electrical interruption device and an upper part adapted to receive an escutcheon extending from an electrical interruption device cover.

8. The mechanism of claim 5 wherein said plates comprises a U-shaped configuration and are adapted to be attached to an electrical interruption device operating handle by means of a pivot pin.

9. The mechanism of claim 1 wherein said actuator handle pulls an electrical interruption device handle to an ON position.

10. The mechanism of claim 1 wherein said actuator handle pulls an electrical interruption device handle to an OFF position.

* * * * *